US007383798B1

(12) United States Patent
Antonov et al.

(10) Patent No.: US 7,383,798 B1
(45) Date of Patent: Jun. 10, 2008

(54) HIGHLY EFFICIENT TWO-STROKE DOUBLE COMPRESSION COMBUSTION ENGINE

(76) Inventors: Sergey Antonov, 1214-40 High Park Ave, Toronto, ON (CA) M6P 2S1; Alexei I Antonov, 1604-40 High Park Ave, Toronto, ON (CA) M6P 2S1

( * ) Notice: Subject to any disclaimer, the term of this patent is extended or adjusted under 35 U.S.C. 154(b) by 0 days.

(21) Appl. No.: 11/561,315

(22) Filed: Nov. 17, 2006

(51) Int. Cl.
*F02B 33/22* (2006.01)

(52) U.S. Cl. ..... 123/70 R; 123/70 V

(58) Field of Classification Search ..... 123/70 R, 123/70 V
See application file for complete search history.

(56) References Cited

U.S. PATENT DOCUMENTS 962,250 A * 6/1910 Rockwell ..... 123/41.63
1,609,792 A * 12/1926 Brock ..... 123/70 V
1,666,384 A * 4/1928 Hult ..... 123/70 R
2,303,794 A * 12/1942 Pescara ..... 60/599
2,522,649 A * 9/1950 Tenney ..... 123/70 R
3,774,581 A * 11/1973 Lundy ..... 123/70 R
3,880,126 A * 4/1975 Thurston et al. ..... 123/70 R
3,921,608 A * 11/1975 Kottmann ..... 123/69 R
4,565,167 A * 1/1986 Bryant ..... 123/70 R
5,265,564 A * 11/1993 Dullaway ..... 123/70 R
5,499,605 A * 3/1996 Thring ..... 123/70 R

* cited by examiner

*Primary Examiner*—M. McMahon

(57) ABSTRACT

This invention relates to the field of diesel engines operating on two-stroke cycles. This invention further relates to said diesel engines having piston compressors.

Our invention has disclosed a double compression diesel engine featuring outstanding compression ratio, high thermal efficiency and large power to weight ratio. This engine is more efficient and more powerful than conventional four-stroke engines, having lesser weight and volume. This engine will operate on gasoline, as well as on diesel fuel, because of its large compression ratio.

8 Claims, 4 Drawing Sheets

HIGHLY EFFICIENT TWO-STROKE DOUBLE COMPRESSION COMBUSTION ENGINE

DESCRIPTION

This invention relates to the field of diesel engines operating on two-stroke cycles. This invention further relates to said diesel engines having piston compressors.

BACKGROUND OF THE INVENTION

Two-stroke diesel engines are well known and used excessively in various applications. The main application belongs to the transportation means like cars, bikes, locomotives, boats etc. Great advantages of two-stroke diesel engines are their simplicity, low coast and high power to weight ratio. During long and successful use of said engines numerous efficiency problems became apparent. It is common knowledge of those skilled in the art that said engines are less efficient than four-stroke engines of various types. It is believed that deficiencies are caused by incomplete air charge and incomplete exhaust. Four-stroke engines have separate dedicated pistons' movements for each of these functions.

Though attempts have been made to remedy the deficiencies, still to the best of our knowledge, two-stroke engines remain inferior to those four-stroke ones. The presented invention discloses a novel design of engines which significantly increases efficiency of two-stroke diesel engines. There are two principal goals of this invention that in turn allow for a number of further improvements and advantages. The first goal is to significantly increase the pressure of an air charge above the pressure of exhaust gases at the end of the expansion phase. This excessive pressure is instrumental for pushing-out of the exhaust gases, or, alternatively, for squeezing those exhaust gases into insignificant part of the combustion cylinder. In any case, having the air charge at a pressure multiple times higher than that of the exhaust gases will eliminate scavenging deficiency of the engine. The second goal of this invention is to lower the residual or return volume of the air charge to limit a choke effect. We define residual or return volume as a part of the air charge which is compressed and therefore heated, but does not make it into the combustion cylinder. At the following intake phase that return portion of the charge expends reaching the pressure of the intake air and consequently occupies large portion of the pumping cylinder. This repeatable effect reduces effective intake volume and partially chokes the engine. Our invention discloses the apparatus minimizing return volume and therefore greatly reducing said choke effect.

Important consequence of said two goals is a double compression cycle. Due to the pumping cylinder being necessarily many times larger than the combustion cylinder, the resulting total compression ratio for the air charge, by the moment of the fuel injection, will be the result of multiplication of the compression ratio of the combustion cylinder by the volume ratio of the pumping cylinder and the combustion cylinder. It is quite conceivable that said total compression ratio could be more than a hundred. There is a significant increase in thermal efficiency of the engine due to said outstanding compression ratio.

PREFERRED EMBODIMENT

Figure 1:
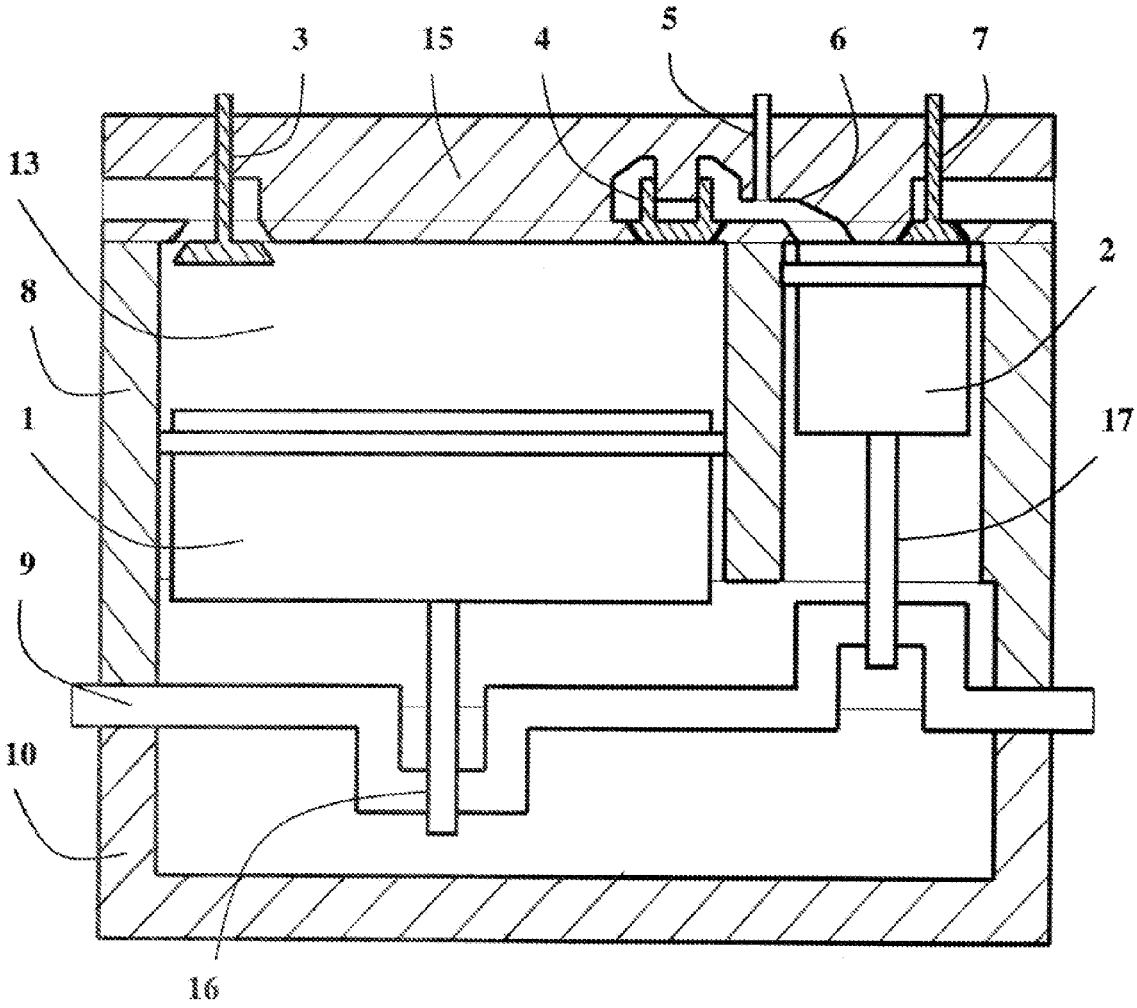
FIG. 1 shows a cross section of a double compression two-stroke diesel engine at its fuel injection phase. Embodiment with an exhaust valve 7 in the combustion cylinder is presented.
Figure 2:
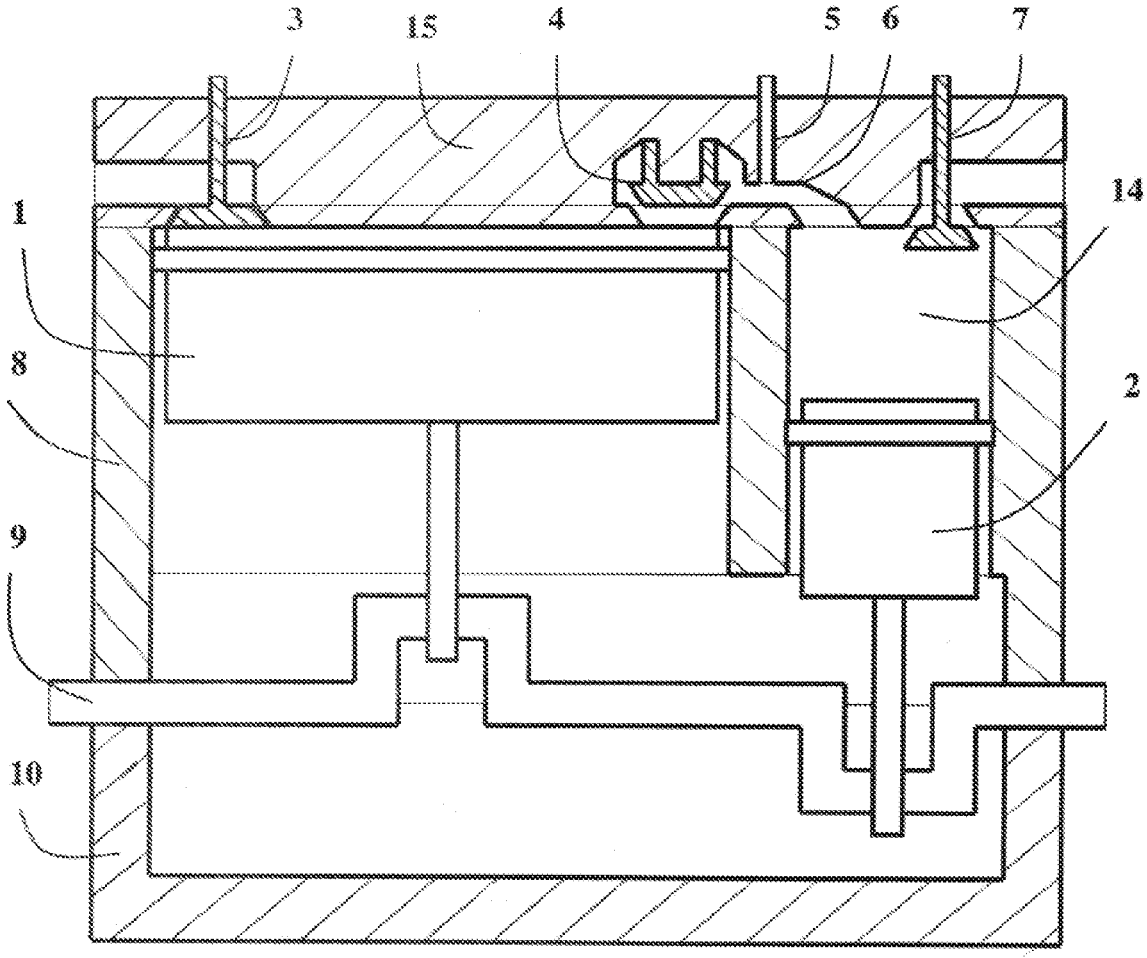
FIG. 2 shows a cross section of the double compression two-stroke diesel engine at its exhaust phase, when an air charge of the pumping cylinder is transferred into the combustion cylinder 14. Embodiment with the exhaust valve 7 in the combustion cylinder 14 is presented.
Figure 3:
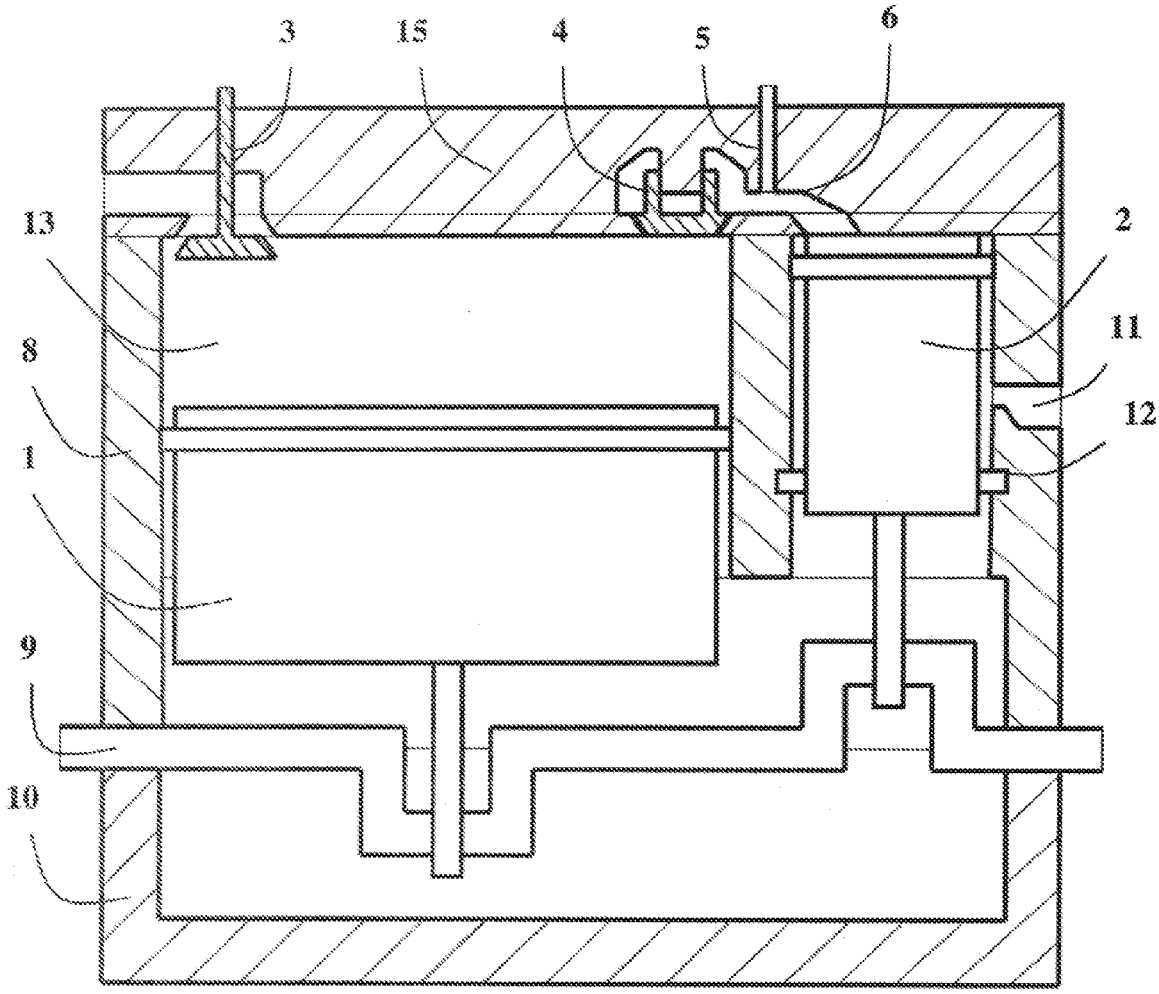
FIG. 3 shows a cross section of a double compression two-stroke diesel engine at its fuel injection phase. Embodiment with an exhaust port 11 in the combustion cylinder is presented.
Figure 4:
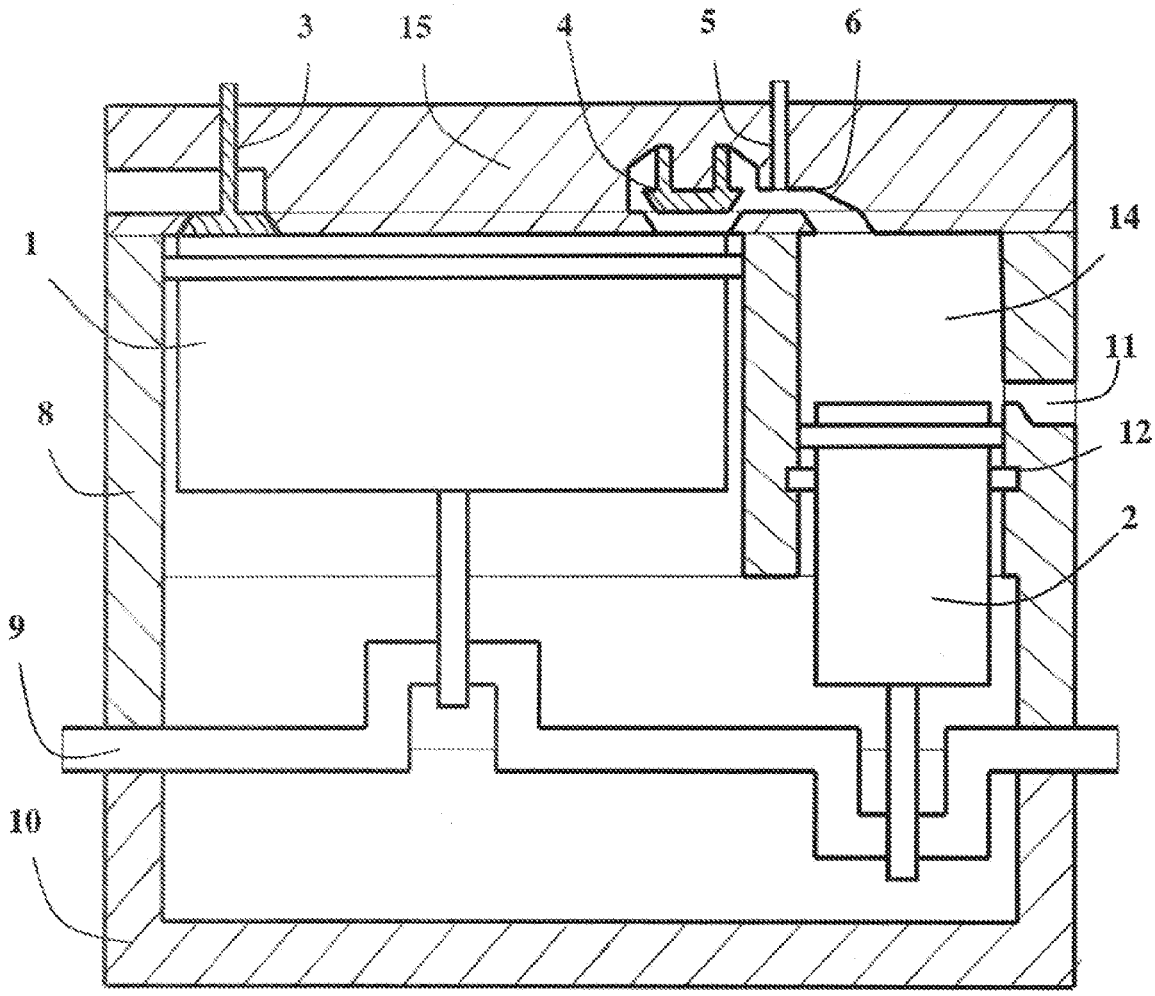
FIG. 4 shows a cross section of the double compression two-stroke diesel engine at its exhaust phase, when an air charge of the pumping cylinder is transferred into the combustion cylinder 14. Embodiment with the exhaust port 11 in the combustion cylinder 14 is presented.

The preferred embodiment of this invention is an apparatus having a pumping cylinder 13 and a combustion cylinder 14, a cylinder block 8, a crankcase 10 attached to this block including a crank shaft 9, at least two piston roads 16, 17 and two pistons 1,2 attached to them. Both cylinders have flat bottoms. Both pistons have flat faces. We recommend that the combustion cylinder 14 should have a diameter of ⅓ or less than that of the pumping cylinder 13. The apparatus further includes a cylinder head 15 containing an air intake path with a valve 3 for the pumping cylinder 13; further containing an exhaust path with a valve 7 for the combustion cylinder; also containing a transfer path 6 formed as a recess in the cylinder head connecting the pumping and combustion cylinders; said transfer path having valve 4 at the pumping cylinder; said valve is a unidirectional free floating conical edge type. The valve could have a spring. It is preferred that the valve does not have a rod protruding through the cylinder head 15.

The cylinder head further contains a fuel injector 5 opening into said transfer path 6. It is essential that said transfer path works as a combustion chamber. The construction of said transfer path and the valve 4 inside it allows to keep a displacement of the transfer path at an absolute minimum, therefore providing for large expansion ratio of the combustion cylinder.

The piston of the pumping cylinder and the piston of the combustion cylinder could be mounted on a crankshaft at 180 degrees relative position (phase shift between the pistons, as measured by degrees of the crankshaft revolution). That means, when the pumping piston is at its farthest position from the crankshaft axis, the combustion piston is at its closest position to the crankshaft axis.

It may be beneficial to increase a phase between the pumping piston and the combustion piston beyond 180 degrees. That would already have the combustion piston at its compression phase at the moment when the pumping piston reaches the bottom of its cylinder. This arrangement allows for longer expansion phase of the combustion cylinder at the expense of its shorter compression phase. The best performance of the engine having the exhaust valve 7 will be achieved by using some optimum phase shift between the pumping and combustion cycles. Said optimum phase shift could be found between 180 and 300 degrees of shaft revolution.

Yet another preferred embodiment of this invention employs an exhaust port 11 in the combustion cylinder. This embodiment will not have the exhaust path in the cylinder head. The exhaust path will be in the cylinder block having not a valve, but a port or opening in the wall of the combustion cylinder. The port is opened by the piston while said piston is near its closest position to the crankshaft axis. Particular advantage of this embodiment presents itself into farthest relative position of the transfer path and the exhaust port. This is instrumental for the air charge to push the exhaust gases away, as the charge moves via the transfer path into the combustion cylinder. For this embodiment we recommend at least one obturation ring 12 to be installed into the wall of the combustion cylinder 14 on the crankcase side of the port. Said ring 12 could be placed into the wall. The ring shall be cut open in one place and shall be allowed to spring, similar to those obturation rings at the piston. The difference between this ring and those at the cylinder is in the direction of squeezing. The piston ring pushes against the cylinder wall, the cylinder ring pushes against the piston. This arrangement keeps the exhaust gases away from the crankcase, crankshaft and piston rods.

Our invention has disclosed a double compression diesel engine featuring outstanding compression ratio, high thermal efficiency and large power to weight ratio. This engine is more efficient and more powerful than conventional four-stroke engines, having lesser weight and volume. This engine will operate on gasoline, as well as on diesel fuel, because of its large compression ratio.

Our invention could be used with pre-compressed air, such as conventional turbocharged, supercharged and the like.

We claim:

1. An internal combustion engine comprising:

a pumping cylinder having a reciprocating piston, an intake air valve and a transfer air valve;

a combustion cylinder having a reciprocating piston and an exhaust valve;

a transfer path forming a combustion chamber and allowing to transfer an air charge from the pumping cylinder into the combustion cylinder;

means for injecting fuel into the combustion chamber;

a crankshaft in a crankcase;

means for connecting the pistons of the cylinders to the crankshaft;

wherein a displacement of the pumping cylinder is at least two times bigger than a displacement of the combustion one.

2. The internal combustion engine of claim 1 wherein a displacement of the combustion chamber is at least two times less than the displacement of the combustion cylinder.

3. The internal combustion engine of claim 1 wherein there is a phase shift of 180-300 degrees between the pumping and combustion cycles.

4. The internal combustion engine of claim 1 wherein there is a multitude of the pumping and the combustion cylinders connected to the same crankshaft within the same crankcase.

5. An internal combustion engine comprising:

a pumping cylinder having a reciprocating piston, an intake air valve and a transfer air valve;

a combustion cylinder having a reciprocating piston and an exhaust port being opened by the piston;

a transfer path forming a combustion chamber and allowing to transfer an air charge from the pumping cylinder into the combustion cylinder;

means for injecting fuel into the combustion chamber;

a crankshaft in a crankcase;

means for connecting the pistons of the cylinders to the crankshaft;

means to isolate the exhaust port from the crankcase wherein a displacement of the pumping cylinder is at least two times bigger than a displacement of the combustion one.

6. The internal combustion engine of claim 5 wherein a displacement of the combustion chamber is at least two times less than the displacement of the combustion cylinder.

7. The internal combustion engine of claim 5 wherein there is a phase shift of 180-300 degrees between the pumping and combustion cycles.

8. The internal combustion engine of claim 5 wherein there is a multitude of the pumping and the combustion cylinders connected to the same crankshaft within the same crankcase.

* * * * *